United States Patent [19]

Capewell et al.

[11] Patent Number: 4,527,099

[45] Date of Patent: Jul. 2, 1985

[54] CONTROL CIRCUIT FOR GAS DISCHARGE LAMPS

[75] Inventors: Dennis Capewell, Easton; David G. Luchaco, Macungie; Joel S. Spira, Coopersburg, all of Pa.

[73] Assignee: Lutron Electronics Co., Inc., Coopersburg, Pa.

[21] Appl. No.: 473,799

[22] Filed: Mar. 9, 1983

[51] Int. Cl.[3] ..... G05F 1/00; H05B 37/02; H05B 39/04; H05B 41/36

[52] U.S. Cl. ..... 315/291; 315/DIG. 5; 315/DIG. 7; 315/205; 315/207; 315/226; 315/307; 307/252 T; 323/224

[58] Field of Search ..... 315/DIG. 4, 205, 208, 315/209, 291, 307, DIG. 5, DIG. 7, 207, 194, 226; 307/252 T; 323/224, 270, 272

[56] References Cited

U.S. PATENT DOCUMENTS

| | | | |
|---|---|---|---|
| 3,414,768 | 12/1968 | Peek, Jr. | 323/224 |
| 3,588,598 | 6/1971 | Isaacs | 307/252 T |
| 3,684,919 | 8/1972 | Cramer | 307/252 T |
| 3,913,002 | 10/1975 | Steigerwald et al. | 315/208 |
| 4,096,414 | 6/1978 | Howell | 315/291 |
| 4,230,970 | 10/1980 | Potter et al. | 315/307 |
| 4,237,405 | 12/1980 | Kellis | 315/307 |
| 4,350,935 | 9/1982 | Spira et al. | 315/208 |
| 4,453,123 | 6/1984 | Erkman | 315/291 |

*Primary Examiner*—Saxfield Chatmon

*Attorney, Agent, or Firm*—Ostrolenk, Faber, Gerb & Soffen

[57] ABSTRACT

A gas discharge lamp control circuit for an inductive ballast includes anti-parallel connected controlled rectifiers connected in series with the a.c. source and the ballast and anti-parallel connected controlled rectifiers which are connected in series with a current limiting and energy diversion capacitor and in shunt with the ballast. The controlled rectifiers of the series and shunt switching assemblies are controlled so that, in any given half wave, the related controlled rectifier of the shunt switching means turns on to discharge a capacitor into the normally conducting controlled rectifier of the series switching means to produce a notch in the voltage wave form applied to the inductive ballast. The capacitor acts as a current limiting impedance and acts to permit reversal of the voltage during the notch interval in the input voltage to the ballast, thereby to increase the RMS content of the voltage wave form. An automatic low end dim setting circuit maintains the low end setting regardless of the type of lamp or ballast which is employed. A notch signal generating circuit is provided which employs two phase-shifted signals fed into a comparator and compared to a common reference level.

28 Claims, 15 Drawing Figures

12
10
13
14
21
17
20
15
16
32
41
44
42
45
43
40
46
30
31
50
47
11
TO OTHER
BALLASTS

62
CONTROL
CIRCUIT
10
12
61
60
TO BALLASTS
63
64
71
CONTROL
CIRCUIT
67
68
30
31
69
70
80
+
81
65
66
82
11
73
TO BALLASTS

BALLAST INPUT VOLTAGE
$t_1$ $t_2$
TIME
65°
$t_1$ $t_2$
$t_1$ $t_2$

BALLAST INPUT VOLTAGE
$\Delta v$

BALLAST INPUT VOLTAGE
TIME
$\Delta v$

LOAD CURRENT
TIME

LINE VOLTAGE $t_1$ $t_2$
$t_1$ $t_2$
60-61

$t_0$
30

31

TIME
$t_1$
$t_2$
$t_3$

CONTROL CIRCUIT FOR GAS DISCHARGE LAMPS

RELATED APPLICATIONS

This application is related to copending application Ser. No. 473,800, filed Mar. 9, 1983, entitled LOAD SWITCHING ARRANGEMENT FOR GAS DISCHARGE LAMP CIRCUIT, in the names of Longenderfer, Luchaco and Capewell and is assigned to the assignee of the present invention.

BACKGROUND OF THE INVENTION

This invention relates to a control circuit for gas discharge lamps, and more particularly relates to a control circuit which permits improved dimming of large numbers of various kinds of gas discharge lamps.

The present invention is an improvement over the circuits disclosed in U.S. Pat. No. 4,350,935, dated Sept. 21, 1982, entitled "Gas Discharge Lamp Control" in the name of Joel S. Spira et al. and assigned to the assignee of the present invention. As disclosed in U.S. Pat. No. 4,350,935, it is possible to regulate the output light of one or more fluorescent lamps by applying a voltage wave form to the lamp ballast which has a notch in each of the half waves, which notch is of variable width and of variable location within the half wave form.

The circuit arrangement shown in U.S. Pat. No. 4,350,935 provides good operation over a wide range but has several shortcomings. For example, the circuit employs a series switching means and shunt switching means for an inductive ballast. The series switching means is a high speed transistor which is operable to turn off at some desired point in the input voltage wave form to produce the desired notch in the input voltage. The shunt switching means turns on during this notch interval to provide a bypass path for the discharge of energy from the ballast. The shunt switching devices consist of anti-parallel connected controlled rectifiers. If, for any reason, a spurious control signal is applied to the controlled rectifiers out of their proper sequence, it becomes possible to produce a short circuit from the a.c. voltage power line through the series switching transistor and the parallel switching device. This could seriously damage or destroy the series switch.

Another shortcoming of the circuit of U.S. Pat. No. 4,350,935 is that the lamp life of energy saving lamps reduces when the lamps are operated in their lower dimming end region. One reason for this is that as the notch width increases, the RMS content of the voltage applied to the inductive ballast decreases. As a consequence, the effective output voltage of the filament transformers decreases so that the lamps will extinguish at relatively low dimming.

A further difficulty experienced with the arrangement of U.S. Pat. No. 4,350,935 is "tracking" several banks of lamps so that they dim by the same amount. Proper tracking requires placement of the notch close to the start of each of the half waves in the nearly fully illuminated condition so that the notch can move to the right during dimming without causing some or all of the lamps to drop out while remaining lamps become very bright.

BRIEF DESCRIPTION OF THE PRESENT INVENTION

In accordance with a first feature of the present invention, the control circuit of U.S. Pat. No. 4,350,935 is modified such that the series switching means and shunt switching means can both be formed of anti-parallel connected controllably conductive devices such as transistors or controlled rectifiers. Commutating capacitors are discharged into the series switches by firing appropriate ones of the shunt switches in order to produce the notched wave form. The shunt switch also provides a discharge path for stored energy in the inductive ballast.

The novel circuit of the invention has a current limiting topology. Thus, a current limiting impedance, preferably a capacitor, is added in series with the shunt switching means so that the shunt switching means and impedance means are in a series circuit which is in parallel with the inductive ballast. If, for any reason, the devices of the series and shunt switch form a direct connection across the a.c. source, current flow would be limited by the series impedance. The current limiting impedance can also be any combination of resistive, inductive, capacitive or active components either singly or in various combinations. The resistive, inductive and capacitive components or combinations thereof may be linear or non-linear. The active components may be two-terminal or three-terminal devices, semiconductor devices or arc discharge devices or the like. Typically, a break-over semiconductor diode can be used as the active device.

As a further significant feature of the invention, the series impedance is a capacitor and the polarity of its voltage is allowed to reverse due to the transfer of stored ballast energy during a notch interval so that the net voltage applied to the inductive ballast will reverse during the notch period, thus significantly increasing the RMS content of the ballast voltage. By increasing the RMS content of the voltage applied to the ballast, the filament transformers are better operated so that, as the notch is widened, a greater degree of regulation of lamp light can be obtained than was previously possible. The rapid reversal of voltage across the ballast due to the capacitor also helps to maintain lamp ionization during the notch interval; minimizes lamp current crest factor; and also provides the well-known advantages of high frequency operation of gas discharge lamps.

It has also been found that, when employing the circuit of the present invention, the notch can be located closer to the 90° angle within each of the half waves of the input voltage wave shape to the ballast. By locating the notch in this position, the RMS content of the applied voltage is further increased, and it is still possible to obtain satisfactory tracking throughout the dimming range.

A novel automatic low end set circuit is provided which automatically adjusts for the different dimming curve of standard lamps and ballasts as compared to energy saving lamps and ballasts. The novel automatic low end set circuit will automatically calibrate the size of the notch so that a specified setting percentage from full illumination is maintained regardless of the type of lamp or ballast connected. The automatic low end set circuit employs, as an input, either the RMS voltage input to the ballast or the total load current. This is used to generate a signal to one input of an error amplifier and is compared to a suitable reference value. The output error is then employed to adjust notch width and location.

A novel notch signal generator is also provided and consists of a two phase shift network arrangement fed into a comparator circuit. The two phase shifted signals are compared to a given signal level and produce a signal output when the phase shifted signals are above and below, respectively, the preset level in order to mark the beginning and the end of the notch signal. The novel notch signal generating circuit provides very stable operation even on lines which are unstable due to large inrush currents due to air conditioning compressors and other types of motors being started, as an example.

The novel circuit of the invention is applicable to any desired type of gas discharge lamp, including but not limited to all types of fluorescent lamps and high intensity discharge lamps.

Figure 2:
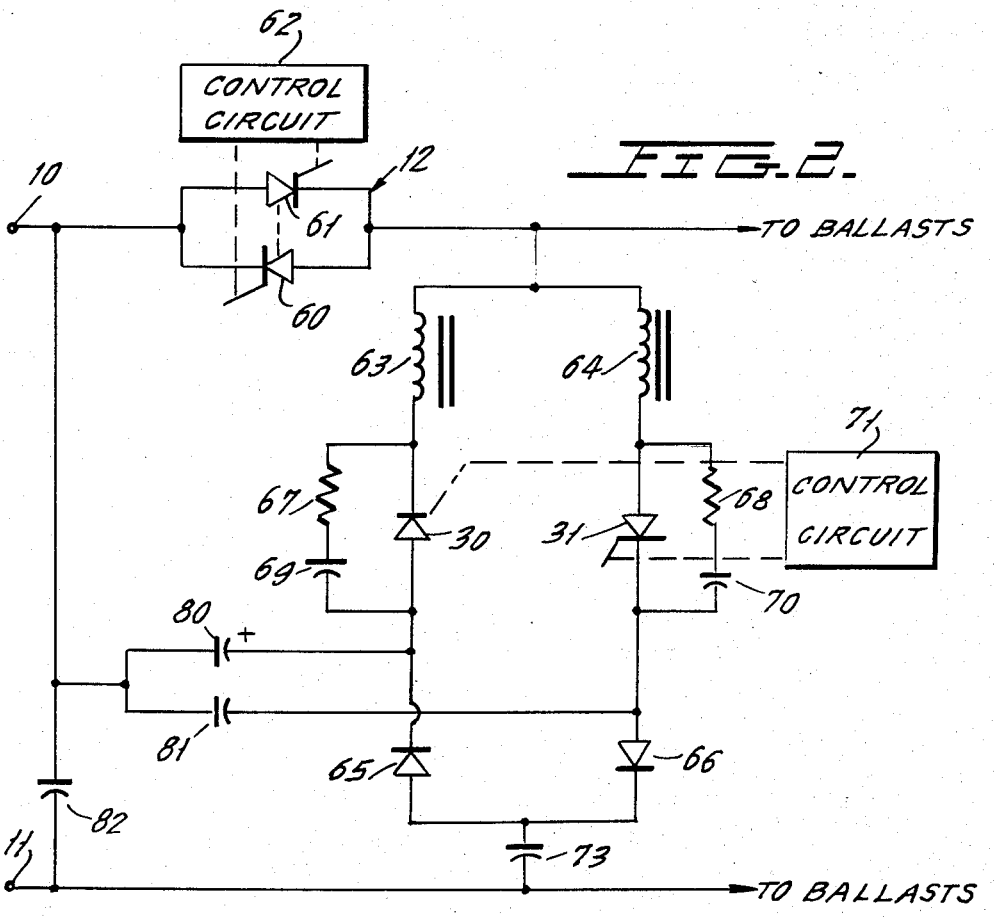
FIG. 2 is a circuit diagram of a second and preferred embodiment of the invention.

FIGS. *7a* through *7e* are timing diagrams to show the timing of firing signals to the controlled rectifiers of FIG. 2.

Figure 8:
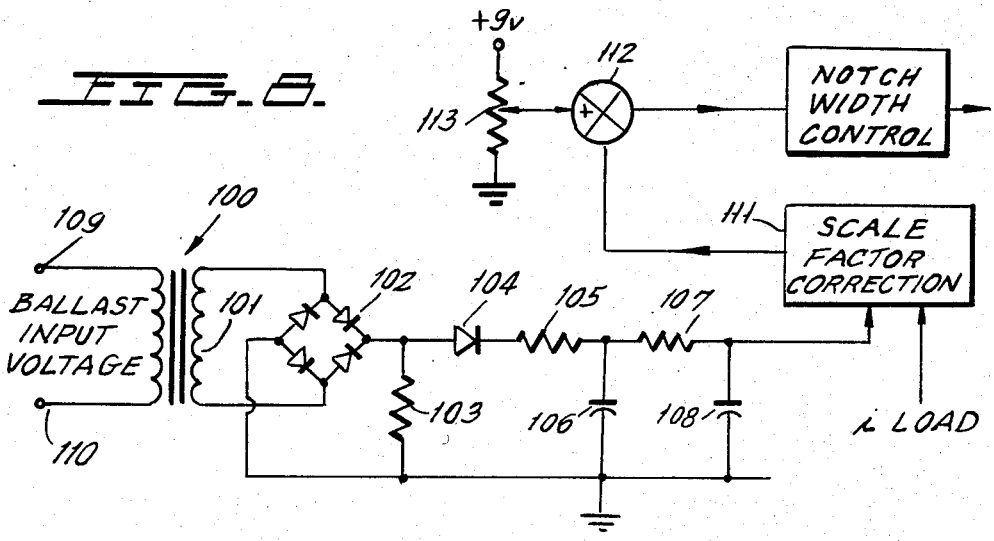

FIG. 8 is a circuit diagram of a first embodiment of an automatic low end set circuit for maintaining a constant illumination level regardless of the kind of ballast and lamp which are employed in the load circuit.

Figure 9:
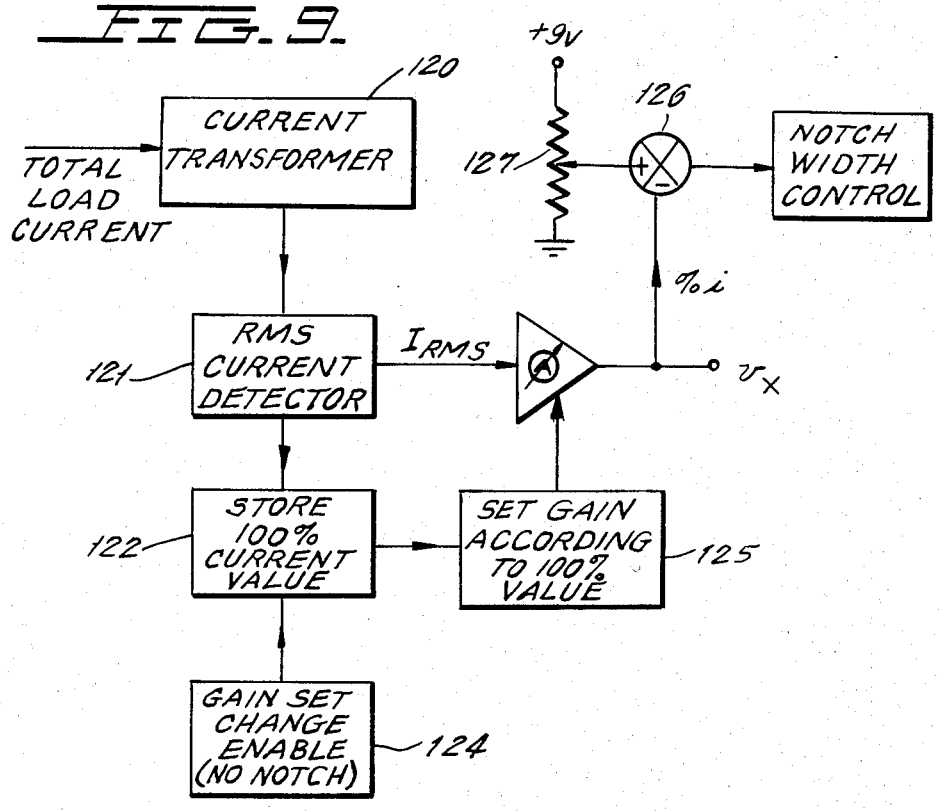

FIG. 9 is a circuit diagram of a second embodiment of an automatic low end set circuit.

Figure 10:
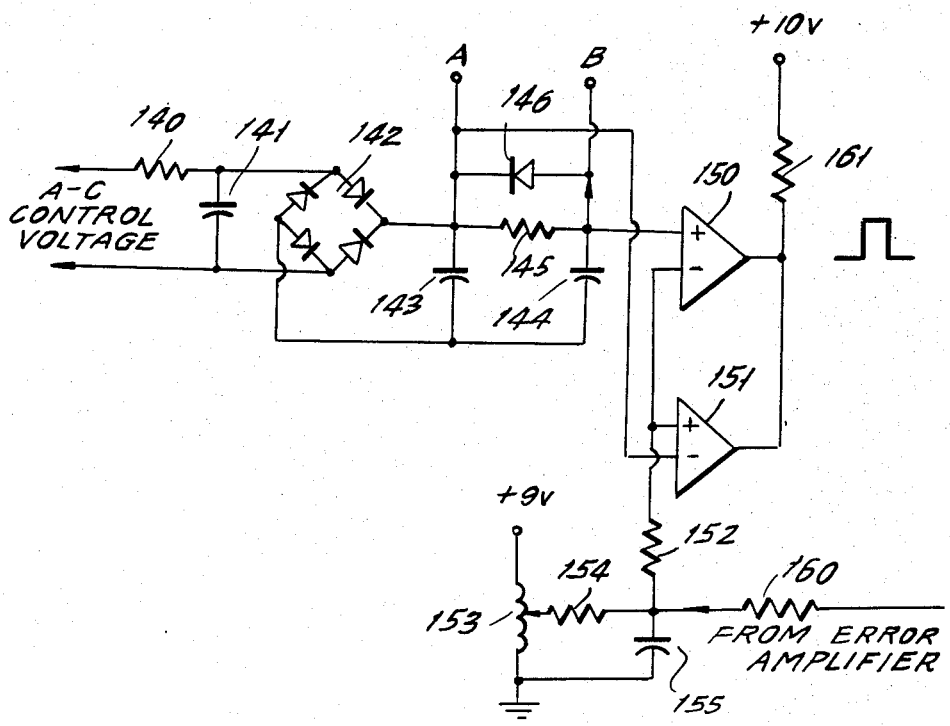

FIG. 10 is a circuit diagram of a circuit for generating the notch signal shown in FIG. *7b*.

Figure 11:
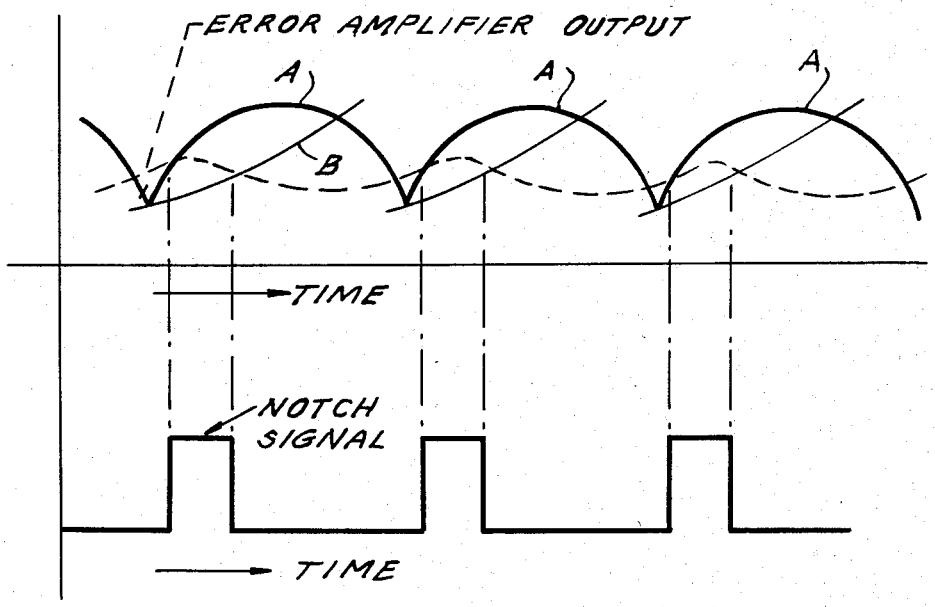

FIG. 11 shows the phase-shifted voltages as a function of time which are employed in the circuit of FIG. 10 and the notch signal which is produced.

DETAILED DESCRIPTION OF THE DRAWINGS

Figure 1:
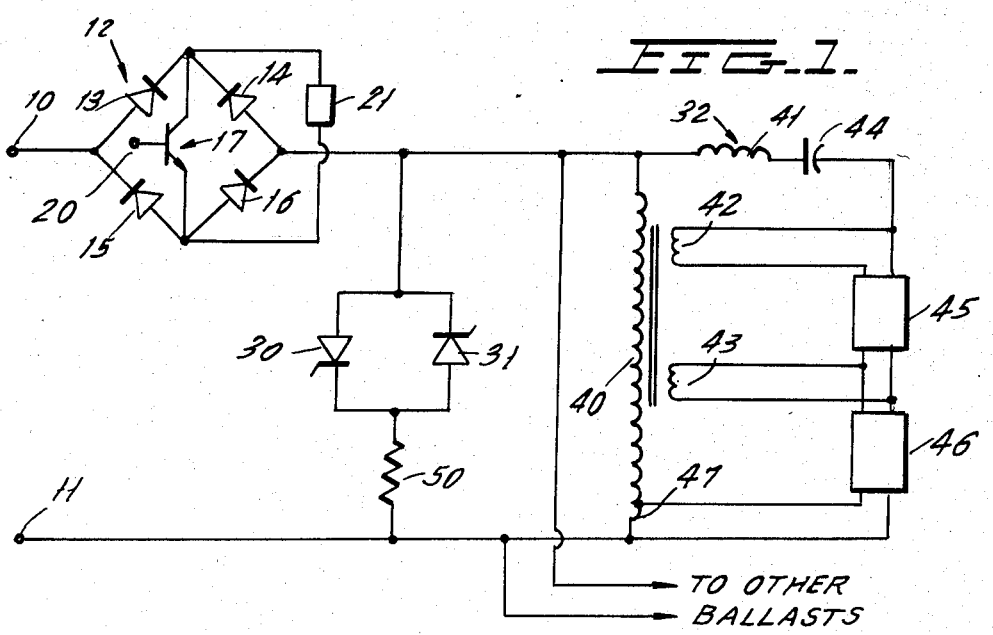
FIG. 1 is a circuit diagram of a first embodiment of the invention.

Referring first to FIG. 1, there is shown a control circuit which contains most of the components of the prior art control circuit of U.S. Pat. No. 4,350,935 along with an exemplary inductive ballast and lamps operated by the ballast. A plurality of parallel connected ballasts and lamps can be provided. A conventional a.c. power line of any desired voltage and frequency, typically 277 volts and 60 Hz, is connected to the circuit input terminals 10 and 11.

A series switching means 12 is provided which consists of a single phase, full wave rectifier bridge containing diodes 13, 14, 15 and 16 and a high speed switching transistor 17 connected across the d.c. terminals of the bridge 12. An appropriate control circuit (not shown) is connected to the base 20 of transistor 17 as is described in U.S. Pat. No. 4,350,935.

A "crowbar" circuit 21, which is a high speed protective switching means, is connected across the transistor 17 to protect the transistor during lamp switch-on when high surge currents might flow through the transistor 17.

There is also provided a shunt switching means consisting of anti-parallel connected controlled rectifiers 30 and 31 which are connected in parallel with the inductive ballast 32. Ballast 32 may be a conventional ballast and is one of any desired number of parallel connected ballasts which are operated from the same control circuit. The ballast illustrated consists of a primary winding 40 having a secondary winding 41 and filament power windings 42 and 43 coupled thereto. A capacitor 44 is connected in series with winding 41 as shown. Ballast 32 is connected to two series-connected gas discharge lamps 45 and 46. Lamps 45 and 46 can, if desired, be energy saver type fluorescent lamps of commercially available types. Other lamps could be used.

Ballast filament winding 42 is connected to the upper filament of tube 45 while filament winding 43 is connected to the lower filament of tube 45 and the upper filament of tube 46. The lower filament of tube 46 is heated by the voltage from a winding tap 47 of the winding 40.

Figures 3, 4, 5, 6, 7A, 7B, 7C, 7D, 7E:
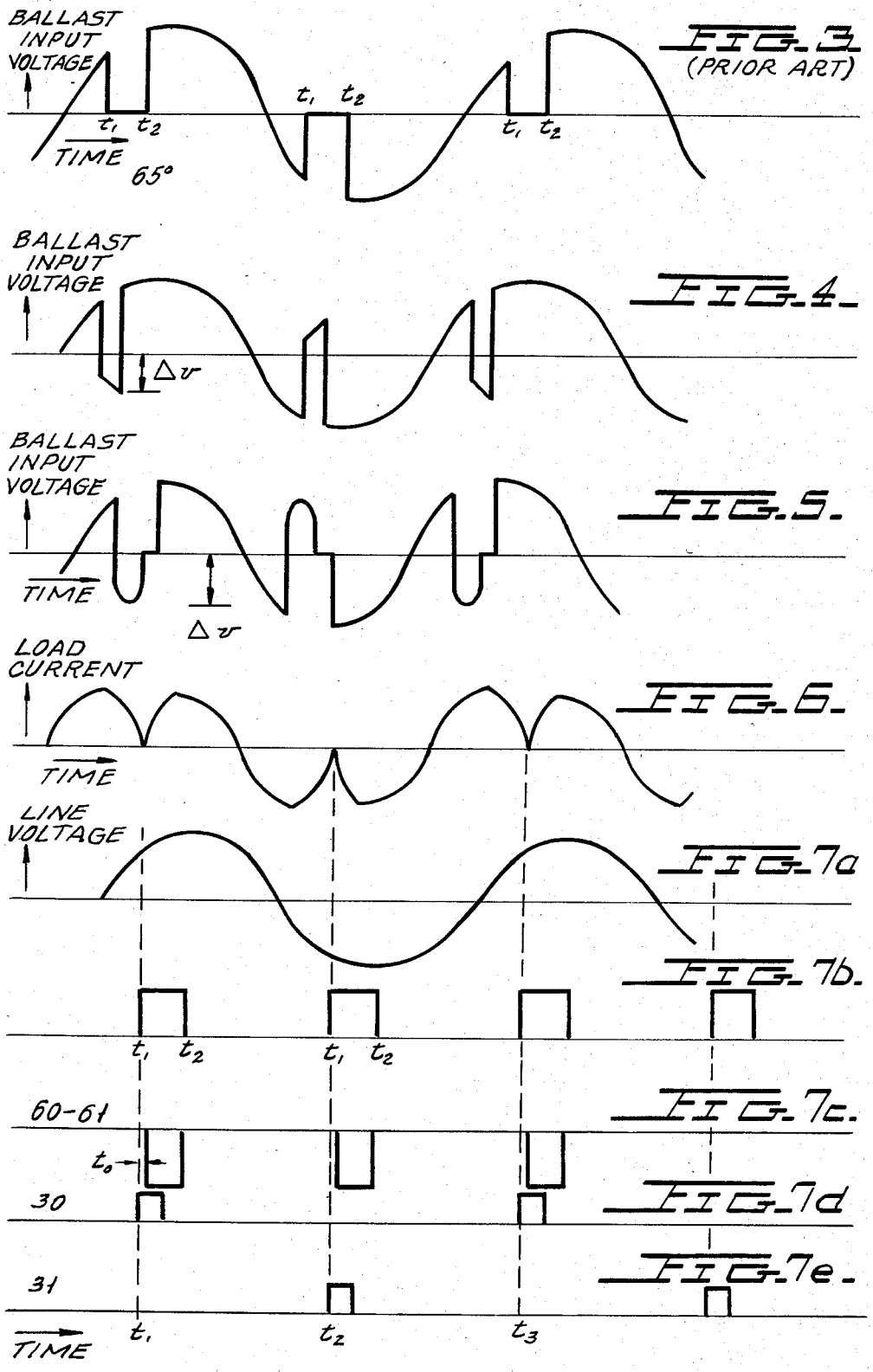
FIG. 3 (PRIOR ART)
FIG. 3 shows the ballast input voltage as a function of time for a prior art control circuit.
FIG. 4 shows the ballast input voltage as a function of time for the circuit of the present invention at a high illumination condition.
FIG. 5 is similar to FIG. 4 and shows the notch moved to an increased dimming position.
FIG. 6 shows the load current for the circuit of FIG. 2 in the dimming condition of FIG. 5.

The structure described to this point, and excluding resistor 50 to be later described, is essentially identical to that of U.S. Pat. No. 4,350,935. The transistor 17 is controlled such that, as shown in FIG. 3, the transistor turns off at time $t_1$ and turns on at time $t_2$ in each half wave to produce a notch in the voltage wave shape. In order to permit discharge of the ballast energy during the notch interval between times $t_1$ and $t_2$, the appropriate controlled rectifier 30 or 31 is switched on to permit the flow of discharge current from the ballast. For example, during the half wave in which terminal 10 is positive relative to terminal 11, controlled rectifier 30 will turn on when the transistor 17 turns off. If, however, during any period outside of the notch interval the controlled rectifier 30 is turned on, then a direct short circuit would appear from terminal 10 through transistor 17, controlled rectifier 30 and back to terminal 11. This direct short circuit could cause serious damage or destruction of the high speed transistor 17.

In accordance with one aspect of the present invention, an intentional current limiting impedance is provided in series with the shunt switching means 30–31. In FIG. 1 this current limiting means is shown in its simplest form as resistor 50. If now there is a spurious control signal which causes "shoot through" of current through the transistor 17 and one of controlled rectifiers 30 or 31, the current would be limited by the impedance 50, thus tending to protect the transistor 17 by limiting the maximum current through the transistor during the half wave.

A second and preferred embodiment of the invention is shown in FIG. 2. In FIG. 2, the current limiting impedance is a capacitor 73. The capacitor 73 is also employed to increase the RMS content of the voltage wave form applied to the ballast as will be described.

Referring to FIG. 2, components similar to those of FIG. 1 have been given the same identifying numerals. Thus, there is provided a series switch 12. In FIG. 2, the series switching means 12 consists of anti-parallel connected controlled rectifiers 60 and 61. Other controllably conductive devices could be used. The gates of controlled rectifiers 60 annd 61 are operated by pulses derived from a suitable control circuit 62.

A shunt switching means is provided in FIG. 2 which includes rectifiers 30 and 31 or any other type of controllably conductive device which is desired. Controlled rectifiers 30 and 31 are connected in series with respective inductors 63 and 64 and with series diodes 65 and 66, respectively. Inductors 63 and 64 may be 90 microhenry air core inductors. Note that diodes 65 and 66 are poled identically to the poling of controlled rectifiers 30 and 31, respectively. A control circuit 71 is provided to control the firing of controlled rectifiers 30 and 31. Snubber circuits consisting of resistors 67 and 68 and respective series-connected capacitors 69 and 70 are connected in parallel with controlled rectifiers 30 and 31, respectively. Inductors 63 and 64 also provide inductance for the snubber circuits of controlled rectifiers 30 and 31 and also provide inductance in the commutation circuits which is necessary to turn off controlled rectifiers 60 and 61 with the initiation of their respective notches.

Capacitor 73 is an energy divertor and current limiting component connected in series with the shunt switch circuit and the series connected shunt switch circuit and capacitor 73 are connected in parallel with the various ballasts. Capacitor 73 can be replaced by any combination of resistive, inductive, capacitive or active components either singly or in various combinations. The resistive, inductive and capacitive components or combinations thereof may be linear or non-linear. The active components may be two-terminal or three-terminal devices, semiconductor devices or arc discharge devices or the like. Typically, a break-over semiconductor diode can be used as the active device. Note that the current limiting divertor structure can be connected across the series switching means 12 and the shunt switch means may be eliminated.

The output of the control circuit of FIG. 2 is connected suitably to ballasts which may be identical to ballast 32 of FIG. 1.

Two commutating capacitors 80 and 81 are connected between terminal 10 and the node between diode 65 and controlled rectifier 30 and the node between diode 66 and controlled rectifier 31, respectively. A conventional input filter capacitor 82 is connected across the input terminals 10 and 11.

It will be noted that the arrangement of the circuit of FIG. 2 is current limiting since the impedance of capacitor 73 is in series with any path which can result due to a spurious control signal applied to controlled rectifiers 30, 31, 60 and 61. Similarly, inductors 63 and 64 are current limiting in the circuit including capacitors 80, 81 and 73 in the event of an incorrect controlled rectifier firing. Thus, the circuit is inherently very rugged.

The manner in which the circuit of FIG. 2 operates is described in the following with reference to FIGS. 4, 5, 6 and 7*a* to 7*e*. The control signals which are to be applied from the control circuits 62 and 71 to controlled rectifiers 30 and 31, 60 and 61 are shown in FIGS. 7*c*, 7*d* and 7*e* relative to line voltage shown in FIG. 7*a* and the width of the desired notch shown in FIG. 7*b*.

The notch signals shown in FIG. 7*b* are to be initiated at time $t_1$ and extinguished at time $t_2$ so that the notch width will be the distance $t_2$ minus $t_1$. A notch-producing circuit is described hereinafter with reference to FIG. 10. During positive half waves, a firing pulse is applied to controlled rectifier 30 at the instant of the beginning of the notch period. After a short time delay, $t_D$, shown in FIG. 7*c*, the conducting controlled rectifier 61 will be commutated off. Controlled rectifier 61 is then turned on again at the time $t_2$. During negative half waves and as shown in FIG. 7*e*, the controlled rectifier 31 turns on at the beginning of the notch at time $t_1$ and the controlled rectifier 60 will commutate off after a short time delay, and will be turned back on again at the end of the notch.

FIG. 4 shows the ballast input voltage for a notch condition in which the notch is initiated relatively early in the half wave and in which the notch width is relatively short to obtain a relatively small degree of dimming of the output light, for example, to 95% of full illumination. Note that, at full illumination, the notch may be eliminated.

It will be noted that the voltage swings through zero in each half wave during this notch interval. This is because capacitor 73 goes to the opposite polarity as the load inductance stored energy is transferred through one of diodes 65 or 66 and controlled rectifier 30 or 31, respectively. At the same time, the commutating capacitor 80 or 81 is properly charged to be ready for a commutation operation during the next interval. As a result of the voltage swing through zero, the RMS voltage, which is applied to the ballast, will be significantly higher than in the prior art circuit in which the voltage during the notch interval is clamped to zero, as shown in FIG. 3.

In order to obtain regulation or dimming, and as will be described in more detail later, the notch position is progressively widened and is progressively moved to the right, as shown in FIG. 5. In the condition of FIG. 5, lamp dimming may be at about 50% of full illumination. The load current wave shape of the load current flowing through the ballasts is shown in FIG. 6 for the regulation condition of FIG. 5.

The operation of the circuit of FIG. 2 is now described in more detail.

Immediately prior to the time terminal 10 becomes positive, the capacitor 80 will be positively charged as shown. Capacitor 80 was charged in the prior half cycle through diode 65. The control circuit 62 causes the controlled rectifier 61 to conduct when the line voltage becomes positive and energy begins transferring from the load to the ballast until time $t_1$ in FIG. 7*b* when a notch is to be placed in the input voltage wave shape. At this instant, controlled rectifier 30 is fired by the control circuit 71. Capacitor 80 then discharges through the closed circuit including controlled rectifier 30 and the forwardly conducting controlled rectifier 61. The discharge current commutates down the forward current of controlled rectifier 61 and promptly turns off the controlled rectifier 61.

The output voltage wave shape at the beginning of the notch will then swing through zero in a negative direction due to transfer of load inductance stored energy to capacitor 73. At the same time, the capacitor 81 is being charged to a condition in which it can commutate-off controlled rectifier 60 during the negative half cycle and when controlled rectifier 31 is fired.

For proper operation of the circuit of FIG. 2, the novel capacitive divertor 73 will preferably have a low impedance compared to that of capacitors 80 and 81. Good results have been obtain when employing a 25 microfarad, 440 volt oil-filled capacitor for divertor capacitor 73 and 1 microfarad, 800 volt oil-filled capacitors for capacitors 80 and 81.

An unexpected advantage of the circuit of FIG. 2 and due to the increased RMS voltage content supplied to the ballast is that it can operate the lamp filaments of lamps 45 and 46 (FIG. 1) of energy saving lamps as well as standard lamps at a much lower minimum setting. For example, in energy saving lamps, it has been difficult to reduce output light significantly because the reduction in filament voltage causes decreased lamp life for energy saving lamps. In the present invention, however, energy saving lamps can be dimmed to a low end of 40% without lamp life loss, whereas such lamps could not be below 70% with prior art circuits.

It is believed that this improvement is obtained because the wave form of the voltage applied to the ballasts has a higher RMS content than prior circuits because the notch voltage swings through zero.

The circuit of FIG. 2 also permits maintaining the notch position closer to the 90° position within each half wave without incurring tracking problems. When the notch position is closer to 90°, the notch width can be less so that the RMS voltage content is again greater.

The improvement is also due in part to better notch position and notch width control since it is possible, with the present invention, to move the notch shown in FIGS. 4 and 5 further to the right within the half wave without upsetting lamp tracking, as will be later described.

Thus, with the present invention, the notch position can be at approximately 80° into the half wave for the unregulated condition and can then move to the right as the lamp power is regulated down. By contrast, in the prior art, as shown in FIG. 3, the notch must be positioned at about 65° for starting conditions in order to provide adequate tracking. If the notch started at 80° in prior art circuits, some lamps would drop out during regulation while others would be very bright. Since this tracking problem is not as great with the present invention, the notch beginning point can be at about the 80° level so that RMS content is increased over the entire range.

A preferred adjustment and tracking sequence for adjustment of notch width and notch position is as follows:

The notch begins at approximately 45° within the half wave for 95% of full light intensity. In order to decrease the light intensity from 75% of full intensity, the beginning of the notch position is moved to the right and the notch is widened as it moves to the right until full regulation of light intensity, down to about 30% of its full value (for an energy saving lamp) is obtained. At this point, the notch begins at about 80° within the half cycle.

By using this sequence, it has been found that filament voltages can be optimized at the minimum setting and the smallest divertor capacitor possible is used. In general, a smaller capacitor will produce a larger RMS ballast input voltage for a given notch position and width. Therefore, the smallest possible divertor capacitor value is desirable to maximize filament voltages.

The circuit of FIG. 2 operates to produce good automatic load regulation. Automatic load regulation refers to the condition wherein light level can be maintained constant regardless of the number of lamps which are connected to the control circuit and to keeping the filament voltages high enough regardless of the number of lamps connected.

The circuit of FIG. 2 operates extremely well with respect to automatic load regulation because the RMS content of the wave forms of the ballast input voltage does not change significantly with the connection of more or less lamps to the same circuit. It is believed that this occurs because of two compensating factors between the amount of energy which must be taken from the ballast inductance during the notch interval, and the time during which the energy can be depleted. In a case where a maximum number of lamps, for example, 90 lamps, are connected to the system, the greater energy must be diverted but, since the equivalent load resistance and equivalent ballast inductance is less, energy will be depleted at the fastest possible rate from the ballast. In the case of a minimum number of lamps connected, 10 for example, less energy is available but also the depletion rate is correspondingly reduced. Consequently, the RMS voltage in the input voltage wave shape to the ballast stays essentially the same, regardless of the number of lamps driven by the circuit of FIG. 2.

One beneficial result of the good regulation characteristics of the circuit of FIG. 2 is that the value of the divertor capacitor is not critical. Therefore, capacitor 73 of FIG. 2 can be a relatively inexpensive capacitor.

Good results have been obtained with the circuit of FIG. 2 when the timing circuits or control circuits 62 and 71 are such that the notch is held in the center of the lamp arc voltage throughout the dimming curve. This produces the highest filament voltages and the lowest lamp peak arc voltage.

Referring next to FIG. 8, there is shown an automatic low end set circuit which can be employed with the circuit of FIG. 2 in connection with the operation of the control circuits 62 and 71 and in particular for adjusting the position and duration of the notch signal of FIG. 7*b*. Lamps and ballasts are commercially available which are designed to produce light more efficiently, previously referred to as energy saving lamps and ballasts.

The dimming curve of energy saving products has been found to differ from those of standard lamps and ballasts, particularly fluorescent lamps.

The circuit of FIG. 8 automatically calibrates the unit so that the specified low end or any other specified setting or dimming will be maintained regardless of the type of lamp and ballast which is employed. While the circuit is shown particularly in connection with a fluorescent lamp, it should be noted that the operation of the circuit of FIG. 8 will apply to any light source.

In FIG. 8, an RMS voltage detector circuit is formed of a potential transformer 100 which has its primary winding connected to the ballast input voltage and a secondary winding 101 connected to the single phase, full wave bridge connected rectifier 102. An output resistor 103 is connected across the d.c. output terminals of bridge 102 and a diode 104 and resistor 105 are connected in the positive output terminal of bridge 102. A capacitor 106, resistor 107 and capacitor 108 are also provided. The components of FIG. 8 described to this point serve the purpose of an RMS load voltage detector. Thus, the voltage at the node of resistor 107 and capacitor 108 will be proportional to the RMS voltage at the ballast input voltage terminals 109 and 110 in FIG. 8.

The output at the node of resistor 107 and capacitor 108 is then be connected through a scale factor correction circuit 111 or may be connected directly to an error amplifier 112.

Another input to error amplifier 112 is taken from resistor 113 which is connected to a suitable control voltage source, as indicated, to define a voltage standard which can be easily adjusted.

The error signal output of amplifier 112 is then connected to an appropriate notch width control circuit which is operable to produce the notch signal of FIG. 7*b*, modified in accordance with the output of the error amplifier 112. The notch width control circuit will be later described in connection with FIGS. 10 and 11.

The circuit of FIG. 8 is an inexpensive circuit and is accurate, even though actual load current is not measured but only ballast input voltage is measured. Morover, the circuit of FIG. 8 inherently provides line voltage compensation so that no separate circuit is required for this function.

The scale factor correction circuit 111 can be employed if it is desired to correct the circuit operation for the number of lamps which are being excited, which is a function of the total load current. The circuit will also make the slight correction needed by energy saving lamps as compared to standard lamps at light loads. The scale factor correction circuit 111 can be a simple variable gain amplifier in which gain varies in accordance with the magnitude of the load current.

FIG. 9 shows a second embodiment of an automatic low end set circuit in block diagram form. In the embodiment of FIG. 9, the input signal controlling the system is derived from the total load current which is applied to the current transformer 120. The output of the current transformer 120 is then applied to an appropriate RMS current detector circuit 121. The output of circuit 121 is then applied to an appropriate storage circuit 122 which stores a signal related to the 100% value of the total load current at the instant of measurement. The storage circuit 122 can, for example, be a digital counter. The output of detector 121 is also applied to operational amplifier 123.

A circuit 124 is also connected to the storage circuit 122 and consists of a gain set change enable circuit which is operable during a no-notch (full lamp intensity) condition in the voltage to the inductive ballasts of FIG. 2.

The output of the storage or memory circuit 122 is then connected to a gain setting circuit 125 which adjusts the gain of operational amplifier 123 in accordance with the 100% value which is stored in circuit 122. Consequently, as the total load current changes, the input RMS current to operational amplifier 123 will also change to produce an output signal to the error amplifier 126 relative to the standard values set in the adjustable resistor 127. The amplified output error signal is then applied to the notch width control circuit shown which will be later described and which is the same circuit as was shown in FIG. 8.

During a start-up situation or reinitialization after load switching when there is no notch in the voltage to the ballast, the circuit of FIG. 9 will store in memory the value of the full load current. This value will determine the gain of amplifier 123 such that the voltage $v_x$ reaches a value to indicate 100% illumination output. As dimming later occurs, the gain of amplifier 123 is locked in and the voltage $v_x$ will be proportional to the percentage of full load current. This output is applied to the error amplifier 126 and the closed loop system will hold the percentage of full load current at the desired setting by appropriately adjusting the notch width.

FIG. 10 shows the circuit which can be employed to produce a notch signal shown in FIG. 7*b* for the control of the series and shunt switches in FIG. 2.

Referring to FIG. 10, there is an input a.c. control voltage applied through the filter resistor 140, and capacitor 141 which are connected to the a.c. terminals of a single phase, full wave bridge connected rectifier 142. The output voltage of rectifier 142 is connected as shown to capacitors 143 and 144 and resistor 145. The diode 146 is connected across resistor 145 as shown. The node between resistor 145 and capacitor 144 is connected to the positive input of comparator 150 which can be a type LM339 comparator.

The negative input of comparator 150 and the positive input of identical comparator 151 are connected to a resistor 152 in a reference circuit which includes a reference voltage source and resistor 153, resistor 154 and capacitor 155. The outputs of error amplifiers such as the error amplifiers 112 and 126 in FIGS. 8 and 9, respectively, can be applied through the resistor 160 in FIG. 10 to the positive terminal of comparator 151 and the negative terminal of comparator 150. The outputs of comparators 150 and 151 are then connected together and are connected to a resistor 161 which is connected to a 10 volt source.

The circuit of FIG. 10 is a simple two phase shifted network feeding into a comparator. Thus, the voltages at points A and B in FIG. 10 are shown in FIG. 11 as phase-shifted voltages superimposed on a common time base. Voltages A and B fluctuate relative to the dotted line level of the error amplifier output which may vary or bounce due to an unstable system and due to factors such as large in-rush currents taken by air conditioning compressors or other motors on the same line as the lighting power supply. The novel circuit of FIG. 10, however, produces a notch signal which starts when the slope of voltage A intersects the error amplifier output and terminates when the slope of the voltage B intersects the error amplifier output. Thus, a notch signal of the desired duration and position is produced simply by controlling the phase relationships and magnitudes of the voltages A and B and by controlling the level of the error amplifier output or other reference voltage output. If it is desired to increase the notch width, it is necessary only to raise the average level of the reference signal or error amplifier output. This increase in the size of the signal will be accompanied by a gradual shift to the right of the notch signal as is desired.

The system of the invention is compatible with various controller inputs derived from energy management systems, time clocks, photosensors, occupancy detectors and the like. These inputs would be connected to the node between resistor 152 and capacitor 155 in FIG. 10, in lieu of or in addition to potentiometer 153.

Although the present invention has been described in connection with preferred embodiments, many variations and modifications will become apparent to those skilled in the art. It is preferred, therefore, that the present invention be limited not by the specific disclosure herein, but only by the appended claims.

What is claimed is:

1. A gas discharge lamp energizing circuit comprising inductive ballast means connectable to at least one gas discharge lamp; a source of a.c. power; series switching means connected in series with said source of a.c. power and said inductive ballast means; shunt switching means and series connected energy divertor impedance means connected in parallel with said inductive ballast means and in series with said a.c. source and said series switching means; and switching control means connected to said series switching means and to said shunt switching means to synchronously and substantially simultaneously close said series switching means and open said shunt switching means to transfer power from said source of a.c. power to said inductive ballast means, and to simultaneously open said series switching means and close said shunt switching means to produce a short duration notch in each half cycle of the voltage wave form applied to said inductive ballast means; said series connected energy divertor impedance means limiting shoot thru current flow from said a.c. source and through said series switching means in the event that both said series switching means and said shunt switching means are simultaneously closed.

2. The circuit of claim 1 wherein said impedance means is a capacitor.

3. The circuit of claim 1 wherein said series switching means and said shunt switching means both consist of first and second anti-parallel connected controllably conductive devices.

4. The circuit of claim 1 wherein said switching control means is operable to control the duration of said notch, and the position of said notch within the voltage wave form in order to regulate the output of said at least one lamp.

5. The circuit of claim 2 wherein the polarity of the voltage wave form applied to said inductive ballast means reverses during said notch in said voltage wave form, whereby the RMS content of the voltage applied to said inductive ballast means is increased.

6. The circuit of claim 5 wherein said series switching means and said shunt switching means both consist of first and second anti-parallel connected controllably conductive devices.

7. The circuit of claim 6 wherein said switching control means is operable to control the duration of said notch, and the position of said notch within the voltage wave form in order to regulate the output of said at least one lamp.

8. The circuit of claim 5 wherein said inductive ballast means includes filament windings connected to said at least one lamp.

9. The circuit of claim 8 wherein said switching control means is operable to control the duration of said notch, and the position of said notch within the voltage wave form in order to regulate the output of said at least one lamp.

10. The circuit of claim 9 wherein said series switching means and said shunt switching means both consist of first and second anti-parallel connected controllably conductive devices.

11. The circuit of claim 3 which includes respective diodes connected in series with said first and second controllably conductive devices of said shunt switching means, and first and second commutating capacitors connected between the respective nodes between each of said first and second controllably conductive devices and said first and second diodes respectively, and the a.c. input side of said series switching means; said first and second commutating capacitors being operable to commutate to zero the current in said first or second controllably conductive device of said series switching means in response to the conduction of said first or second controllably conductive device of said shunt switching means.

12. The circuit of claim 11 wherein the polarity of the voltage wave form applied to said inductive ballast means reverses during said notch in said voltage wave form, whereby the RMS content of the voltage applied to said inductive ballast means is increased.

13. The circuit of claim 12 wherein said switching control means is operable to control the duration of said notch, and the position of said notch within the voltage wave form in order to regulate the output of said at least one lamp.

14. The circuit of claim 13 wherein said inductive ballast means includes filament windings connected to said at least one lamp.

15. The circuit of claim 11 which further includes rate of rise of current limiting means in series with each of said first and second controllably conductive devices of said shunt switching means, and snubber circuit means for each of said first and second controllably conductive devices.

16. An excitation and dimming circuit for inductively ballasted gas discharge lamps comprising, in combination: a pair of power line input terminals; a pair of ballast terminals; a series switching circuit consisting of a pair of first and second controllably conductive devices connected in anti-parallel relation to one another and connected in series between a first of said pair of power line input terminals and a first of said pair of ballast terminals; a shunt switching circuit consisting of a pair of third and fourth controllably conductive devices and a pair of first and second diodes connected in series with respective and similarly poled ones of said third and fourth controllably conductive devices; said series connected third controllably conductive device and said first diode connected in anti-parallel relation with said series connected fourth controllably conductive device and said second diode; a divertor capacitor; said shunt switching circuit connected in series with said divertor capacitor; said series connected shunt circuit and divertor capacitor being connected between said pair of ballast terminals; and first and second commutating capacitors both having one terminal connected to said first of said pair of power line input terminals and a second terminal connected to a respective node between said third controllably conductive device and first diode, and said fourth controllably conductive device and said second diode respectively.

17. The circuit of claim 16 wherein said controllably conductive devices are both controlled rectifiers.

18. The circuit of claim 16 wherein said commutating capacitors are both substantially larger in capacitance than said divertor capacitor.

19. The circuit of claim 17 wherein said commutating capacitors are both substantially larger in capacitance than said divertor capacitor.

20. The circuit of claim 16, 17, 18 or 19 which further includes firing circuit means for firing said controllably conductive devices in a given sequence, whereby, at a given point in the forward conduction half wave of each of said first and second controllably conductive devices, said third and fourth devices respectively are fired to produce a commutating current due to the discharge of said first and second commutating capacitors respectively through said first and second controllably conductive devices respectively to turn off said devices and to initiate a notch in the voltage wave form applied to said pair of ballast terminals, and whereby a signal is produced to fire said first or second controllably conductive device to terminate said notch and, whereby, during said notch, said divertor capacitor produces a reversal through zero of the voltage applied to said pair of ballast terminals.

21. The circuit of claim 16 which further includes first and second rate of change of current limiting inductors connected in series with said third controllably conductive device and said first diode, and said fourth controllably conductive device and said second diode, respectively.

22. The circuit of claim 16 or 21 which further includes a resistor-capacitor snubber circuit connected in parallel with each of said third and fourth controllably conductive devices.

23. A synchronous pulse generating circuit for producing pulses of variable width and phase location; said circuit comprising, in combination: an a.c. voltage source; a rectifier means for producing a repetitive rectified wave form of the voltage of said a.c. voltage source; a phase shift network connected to the output of said rectifier means; a standard level signal generating means; first and second comparator circuits both having positive and negative inputs; said level signal generating means connected to said positive input of said first comparator circuit and to said negative input of said second comparator circuit; the output of said rectifier connected to the negative output of said first comparator circuit whereby the output of said first comparator circuit switches when the output of said rectifier exceeds said standard level signal generating means and a pulse is initiated; the output of said phase shift network connected to said positive input of said second comparator circuit, whereby the output of said second comparator circuit switches when the output of said phase shift network becomes less than the value of the signal generated by said standard level signal generating means to terminate said pulse; said pulse being varied in length and in phase location relative to the instantaneous phase of said a.c. voltage source by changing the value of the output of said standard level signal generating means.

24. The process of maintaining a constant reduction in available light output from a plurality of parallel connected gas discharge lamps, regardless of the impedance characteristics of said lamps; said process comprising the steps of establishing a 100% output illumination reference signal by, applying a full line voltage to said lamps, measuring an output parameter of said lamps during the application of said full line voltage, and storing said output to establish said 100% output illumination reference signal; generating a control signal corresponding to a desired reduced light output level; scaling said 100% reference signal with said control signal to produce a target light output level signal; measuring an instantaneous output parameter of said lamps; comparing said target light output level signal and said instantaneous parameter to generate an error signal; and modifying the output wave shape to said lamps to change their illumination level in such a manner as to reduce said error signal.

25. The process of claim 24 wherein said instantaneous parameter is the RMS voltage applied to said lamps.

26. The process of claim 24 wherein said instantaneous parameter is RMS load current.

27. The process of claim 24 wherein said lamps are either standard or energy saving fluorescent lamps.

28. The process of claim 24 wherein said modification of wave shape consists of varying the width of a notch in each half wave of an a.c. wave shape.

* * * * *

UNITED STATES PATENT AND TRADEMARK OFFICE

CERTIFICATE OF CORRECTION

PATENT NO. : 4,527,099

DATED : September 3, 1985

INVENTOR(S) : DENNIS CAPEWELL ET AL.

It is certified that error appears in the above-identified patent and that said Letters Patent are hereby corrected as shown below:

In Fig. 2, add: a clear connection line from the node between SCRs 60 and 61 to the node between inductors 63 and 64.

Signed and Sealed this

*Twenty-sixth* Day of *November 1985*

[SEAL]

*Attest:*

DONALD J. QUIGG

*Attesting Officer*

*Commissioner of Patents and Trademarks*